US009850686B2

(12) United States Patent
Carlsson

(10) Patent No.: US 9,850,686 B2
(45) Date of Patent: Dec. 26, 2017

(54) HANDLE DEVICE

(71) Applicant: ASSA OEM AB, Eskilstuna (SE)

(72) Inventor: Fredrik Carlsson, Göteborg (SE)

(73) Assignee: ASSA OEM AB, Eskilstuna (SE)

( * ) Notice: Subject to any disclaimer, the term of this patent is extended or adjusted under 35 U.S.C. 154(b) by 103 days.

(21) Appl. No.: 15/027,440

(22) PCT Filed: Oct. 6, 2014

(86) PCT No.: PCT/EP2014/071277
§ 371 (c)(1),
(2) Date: Apr. 6, 2016

(87) PCT Pub. No.: WO2015/052102
PCT Pub. Date: Apr. 16, 2015

(65) Prior Publication Data

US 2016/0251876 A1 Sep. 1, 2016

(30) Foreign Application Priority Data

Oct. 8, 2013 (EP) ..... 13187689

(51) Int. Cl.
*E05B 47/00* (2006.01)
*E05B 47/06* (2006.01)
(Continued)

(52) U.S. Cl.
CPC ..... *E05B 47/0012* (2013.01); *E05B 1/003* (2013.01); *E05B 15/04* (2013.01);
(Continued)

(58) Field of Classification Search
CPC ..... E05B 47/00; E05B 47/0012; E05B 47/02; E05B 47/023; E05B 47/06;
(Continued)

(56) References Cited

U.S. PATENT DOCUMENTS 5,121,618 A * 6/1992 Scott ..... E05B 9/084 70/367
5,421,178 A 6/1995 Hamel et al.
(Continued)

FOREIGN PATENT DOCUMENTS

CN 201843394 5/2011
CN 102791941 11/2012
(Continued)

OTHER PUBLICATIONS

CN Examiner; Office Action for counterpart China patent application No. 201480003170.3, dated May 3, 2017, SIPO, Beijing China.
(Continued)

*Primary Examiner* — Christopher J Boswell
(74) *Attorney, Agent, or Firm* — Babcock IP, PLLC

(57) ABSTRACT

Handle device for operating doors, windows and the like, comprising a first element (3), which is rotatable about an axis of rotation, a second element (8, 108, 208, 308), and a coupling device which is designed to selectively allow and prevent relative rotation about the axis of rotation between the first and the second element. The coupling device comprises; a first coupling member (15, 115, 215, 315, 515, 615) being connected to the first element; a second coupling member (8, 150, 208, 350) being connected to constituting the second element and at least one engaging member (19, 119, 219, 319, 519) which is displaceable between an engagement position in which it simultaneously engages the first and the second coupling members to thereby prevent relative rotation between the first and second element and a release position in which it is disengaged from at least one of the first and second coupling members to thereby allow relative rotation between the first and second element. A drive member (21, 121, 221, 321, 421, 521, 621) is arranged axially displaceable, concentrically with said axis of rota-
(Continued)

tion, by means of an electrical motor (6, 106, 206, 306, 406, 506) having a rotational output shaft (36, 136, 236, 336, 436, 536, 636). The engaging member and drive member comprise interacting contact surfaces arranged, during axial displacement of the drive member, to displace the engagement member from the release position to the engagement position. The drive member exhibits an interior recess (27, 127, 227, 327, 427, 527). A portion (36, 136, 236, 336, 436*a*, 536, 636) of the output shaft extends axially through the recess. A helical coil spring (38, 138, 238, 338, 538, 638) is arranged in the recess, concentrically about the output shaft, limitedly axially displaceable relative to the drive member and the output shaft and prevented from free rotation relative to the drive member or the output shaft. The output shaft or the drive member is provided with a radially extending spring engagement member (37, 137, 237, 337, 537, 637) which is arranged to engage the helical coil spring for axial displacement of the drive member relative to the output shaft upon rotation of the output shaft.

18 Claims, 18 Drawing Sheets

(51) Int. Cl.
*E05B 15/04* (2006.01)
*E05B 1/00* (2006.01)
*E05B 13/00* (2006.01)

(52) U.S. Cl.
CPC ..... *E05B 47/068* (2013.01); *E05B 47/0665* (2013.01); *E05B 47/0684* (2013.01); *E05B 47/0692* (2013.01); *E05B 2015/0413* (2013.01); *E05B 2047/0017* (2013.01); *E05B 2047/0031* (2013.01)

(58) Field of Classification Search
CPC ..... E05B 47/0607; E05B 47/0657; E05B 47/0665; E05B 47/0669; E05B 47/0673; E05B 47/0676; E05B 47/0684; E05B 47/0688; E05B 47/0692; E05B 2047/0015; E05B 2047/0017
See application file for complete search history.

(56) References Cited

U.S. PATENT DOCUMENTS

| | | | | |
|---|---|---|---|---|
| 5,428,873 | A * | 7/1995 | Hitchcock | E05B 17/2011 24/303 |
| 5,628,216 | A | 5/1997 | Qureshi et al. | |
| 6,297,725 | B1 * | 10/2001 | Tischendorf | E05B 47/0012 340/5.64 |
| 6,598,909 | B2 * | 7/2003 | Lu | E05B 47/0012 292/144 |
| 6,640,594 | B1 | 11/2003 | Yao | |
| 6,651,468 | B2 * | 11/2003 | Aramburu | E05B 13/005 70/189 |
| 7,007,527 | B1 * | 3/2006 | Zehrung | E05B 47/0002 292/144 |
| 7,275,402 | B2 * | 10/2007 | Luling | E05B 47/0615 70/222 |
| 8,011,217 | B2 * | 9/2011 | Marschalek | E05B 47/0011 70/149 |
| 8,539,801 | B2 * | 9/2013 | Calleberg | E05B 47/0011 70/216 |
| 9,482,032 | B2 * | 11/2016 | Bedoian | E05B 1/003 |
| 2012/0198897 | A1 | 8/2012 | Lui | |
| 2013/0015671 | A1 | 1/2013 | Calleberg | |
| 2017/0107739 | A1 * | 4/2017 | Ruff | E05B 45/06 |

FOREIGN PATENT DOCUMENTS

| | | |
|---|---|---|
| DE | 102010018243 | 10/2011 |
| EP | 1174570 | 1/2002 |
| WO | WO2009078800 | 6/2009 |
| WO | WO2011119097 | 9/2011 |

OTHER PUBLICATIONS

Augustinus Middeldorp, International Search Report for related PCT filing PCT/EP2014/071277, dated Oct. 22, 2014, Rijswijk, The Netherlands.

* cited by examiner

HANDLE DEVICE

FIELD OF THE INVENTION

The invention relates generally to a handle device for operating doors, windows, gates, hatches and the like. The invention relates in particular to such a handle device comprising a first element, which is rotatable about an axis of rotation, a second element, and a coupling device for selectively allowing or preventing relative rotation about the axis of rotation between the first element and the second element. The invention has a use, for example, on doors, windows, lockers, gates, hatches and the like that are to be able to be operated using some type of handle, for example a lever handle, a knob, a thumb turn or a handle of the window handle type.

BACKGROUND OF THE INVENTION

In many doors, windows and other such elements provided with a rotatable handle, it is desirable that a part that can be turned or rotated by means of the handle can be selectively coupled to or disengaged from another part. The other part can either be a similarly rotatable part or a stationary part.

When both parts are rotatable, it may be desirable in a disengaged position, for example, to allow the handle to be turned without affecting the other part and, in a coupled position, to allow a rotation movement of the handle to be transferred to the other part. The other part can then be, for example, a swivel pin, such as a handle shank or lever handle shank, which is in turn able to transfer the rotation movement to a follower, a bolt, an espagnolette, a lock or some other device for influencing the state of the door or of the window. In the coupled position, normal operation therefore occurs by way of the handle. In the disengaged position, by contrast, the state of the door or of the window remains unaffected if the handle is turned.

Disengagement of the handle from another rotatable part is sometimes referred to as "free swing". This kind of selective disengagement can be used, for example, as a child safety measure, in order to prevent an external door or a window from being opened from the inside, or in order to prevent damage to a lock or the like coupled to the handle if excessive forces are applied to the handle when the lock is in the locked position.

When the other part is a stationary, non-rotatable part, the rotatable handle can be conventionally fixed or continuously coupled by means of a handle shank or lever handle shank to a bolt, an espagnolette, or a lock, for example, or some other device for influencing the state of the door or the window. Disengagement and coupling between the rotatable handle and the stationary part can then be used, in the disengaged position, to allow operation and, in the coupled position, to block the handle and thereby prevent operation of the door or the window. The coupling between the handle and the stationary part can in this respect be said itself to constitute a lock. This kind of selective disengagement and coupling between the rotatable handle and the stationary part can be used as a child safety measure, for example, or in order to prevent unauthorized persons from operating a door or a window.

In both cases the disengagement and coupling between the rotatable handle and the other part can be achieved manually, for example by operating a mechanical button, a lock cylinder or the like. Recently, however, it has become increasingly more common to bring about this disengagement and coupling by electro mechanical means. This allows disengagement and/or coupling, for example, only when an authorized user has first entered a code via a keypad or has provided an identification via a card reader for electronic cards.

PRIOR ART

WO 2009/078800 describes a handle device with which it is possible to selectively disengage and couple a first rotatable element and a second element. The first element can be, for example, a handle grip, and the second element can be a handle plate or escutcheon. The device comprises an inner coupling member and an outer coupling member and also an engaging member. By moving an activating member axially, it is possible for the engaging member to be placed in and removed from simultaneous engagement with the inner and outer coupling members. When the engaging member is in simultaneous engagement with both coupling members, relative rotation between them is prevented. When the engaging member is removed from simultaneous engagement, relative rotation of the two coupling members is permitted. Axial movement of the activating member is obtained manually or by means of an electrically driven solenoid.

WO 2011/119097 A1 describes a similar handle device for selectively allowing and preventing relative rotation between a first rotatable element and a second element. According to this document, axial movement of the activating member is achieved by means of an electrical motor with a rotational output shaft. The output shaft has a central threaded portion which cooperates with a corresponding threaded portion on the activating member, such that rotation of the shaft in either rotational direction drives the activating member to axial displacement in a corresponding direction. By rotating the shaft a sufficient number of rotations in either direction, the activating member may be brought out of threaded engagement with the shaft. First and second spring members are arranged at opposite axial ends of the activating member for pressing the activating member towards the shaft's threaded portion to thereby re-engage the activating member with the shaft when the shaft is then rotated in the opposite direction.

SUMMARY OF THE INVENTION

An object of the invention is to provide an enhanced handle device which permits selective disengagement and coupling between a first rotatable element and a second element.

Another object is to provide such a handle device which requires comparatively low tolerances at manufacture and assembly A further object is to provide such a handle device that can be configured with small dimensions and has a small axial and radial installation size.

Still another object is to provide such a handle device which is reliable in use.

A further object is to provide a handle device of this kind that requires low electrical energy.

Yet another object is to provide a handle device of this kind that has a high degree of safety and an improved ability to withstand unauthorized manipulation.

A further object is to provide a handle device of this kind that permits relatively simple electrical control.

Yet another object is to provide a handle device of this kind that has a high level of operating safety and a long lifetime.

Another object is to provide a device of this kind that is simple, with few movable parts, and yet permits very secure coupling between the two elements.

These and other objects are achieved by a handle device of the type that is specified in the introductory part of claim 1 and that has the special technical features specified in the characterizing part. The handle device is intended for operating doors, windows and the like. It comprises a first element which is rotatable about an axis of rotation, a second element, and a coupling device which is designed to selectively allow and prevent relative rotation about the axis of rotation between the first and the second element. The coupling device comprises a first coupling member being connected to or forming an integral part of the first element and a second coupling member being connected to or forming an integral part of the second element. At least one engaging member is displaceable between an engagement position in which it simultaneously engages the first and the second coupling members to thereby prevent relative rotation between the first and second element and a release position in which it is disengaged from at least one of the first and second coupling members to thereby allow relative rotation between the first and second element. A drive member is arranged axially displaceable, concentrically with said axis of rotation, by means of an electrical motor having a rotational output shaft. The engaging member and drive member comprise interacting contact surfaces arranged, during axial displacement of the drive member, to displace the engagement member from the release position to the engagement position. The drive member exhibits an internal recess. A portion of the output shaft extends axially through the recess. A helical coil spring is arranged in the recess, concentrically about the output shaft. The coil spring is limitedly axially displaceable relative to the drive member and the output shaft and it is prevented from free rotation relative to the drive member or to the output shaft. The output shaft or the drive member is provided with a radially extending spring engagement member which is arranged to engage the helical coil spring for axial displacement of the drive member relative to the output shaft, upon rotation of the output shaft.

The arrangement of the coupling device's first coupling member, second coupling member and the displaceable engagement member allows for a number of different configurations of the cooperating first and second elements. For instance, both the first and the second elements may be arranged rotatable, such that the coupling device, in the engagement position of the engagement member will transmit a rotational movement of the first element to the second element. In the release position, a rotational movement of the first element is not transmitted to the second element, such that a so called free swing mode is achieved. If the first element is connected to e.g. a handle, actuation of the handle will thus, in the engagement position, be transmitted to any locking member or the like being connected to the second element for actuation of the locking member. In the free swing mode, actuation of the handle will not be transmitted to the locking member such that the entire lock arrangement is inoperable or locked.

Alternatively, the second element could be stationary, i.e. fixable to a door, a window, a lock casing or the like. The rotational first element may then be operationally connected to, on the one hand a handle or the like and on the other hand to a plain spindle, a follower or some other means for the manoeuvring of e.g. a lock bolt, an espagnolette or some other locking member. In such a case, the rotational first element is prevented from rotating when the engagement member is in the engagement position, to thereby prevent manoeuvring of the locking member by actuation of the handle, such that the entire lock arrangement is locked. In the release position, the first element and the handle is allowed to rotate, such that the locking member may be manoeuvred by means of the handle and the entire lock arrangement is thereby unlocked.

Additionally, the inventive arrangement allows for that the engagement member is radially displaceable in and out of simultaneous engagement with the first and second coupling member. Alternatively, the engagement member may be arranged axially displaceable in and out of simultaneous engagement with the first and second coupling member. In both cases, the central positioning of the drive member being arranged axially displaceable, concentrically with the rotational axis of the first element allows for a very space saving design of the handle device. In cases where the engagement member is radially displaceable, the reduced installation dimensions may be optimized with regard to the axial installation length. Correspondingly, when the engagement member is arranged axially displaceable, the installation dimension may be optimized with regard to the radial dimensions.

Further more, the inventive arrangement of the drive member, the motor's output shaft, the helical coil spring and the spring engagement member provides a number of advantages. First, the coil spring pitch may be chosen considerably larger than the thickness of the spring engagement member, while still achieving the desired driving engagement between these two components. This in turn allows for that the coil spring and the spring engagement member may be manufactured with comparatively low demands on manufacturing tolerances. In fact, any suitable standard helical coil spring may be used for driving the drive member as long as it is prevented from free rotation either in relation to the drive member or in relation to the output shaft, depending on which embodiment that is chosen, as will be described more in detail below. The spring engagement member may have any dimensions as long as it is insertable between adjacent coils of the spring and has a radial extension which assures engagement with the spring. In contrast hereto, the previously know arrangement disclosed in WO 2011/119097 A1 and comprising an activating member being brought in and out of threaded engagement with a threaded shaft, requires very high tolerances when machining the cooperating threads. At the high rotational speeds of the motor used for driving the activating member, it has proven that, especially, the end portions of the cooperating threads need to be machined with very high precision for re-engaging the cooperating threads when the actuating member has been driven out of engagement with the threaded portion of the shaft. Additionally, at the previously known arrangement it has proven that a very precise alignment of the cooperating threaded components is required in order to achieve a functioning activating member. With the inventive arrangement of the spring engagement member and the coil spring arrangement, according to the present invention, this problem has been solved in a simple and efficient manner.

At the previously known arrangement, the high rotational speeds in combination with the threaded engagement between activation member and the shaft, at some operational conditions may result in that the treaded engagement is jammed. At some instances it may then not be possible to release the jammed engagement irrespective of in which rotational direction the motor is driven. This problem has been solved by the inventive arrangement comprising a flexible and compressible coil spring which allows relative rotation between the coil spring and the spring engaging member at all instances.

Additionally, with the inventive coil spring and spring engagement member arrangement, the stiffness of the spring may readily be chosen high enough such that the risk of manipulation of the coupling device by applying an axial blow or stroke to the handle device may be kept low.

The arrangement of the coil spring being received in a recess arranged in the drive member further facilitates mounting of the coil spring and thereby assembly of the coupling device and the entire handle device.

The coil spring may have open ends. Hereby, the spring engagement member may readily be brought in and out of engagement with the spring. This in turn allows for that the spring may be axially compressed for pretension of the drive member in either direction, when the spring engagement member has been brought out of engagement at a corresponding axial end of the spring.

The coil spring may be open wounded. Hereby, the engagement between the spring engagement member and the helical coil spring may be achieved with a minimum of friction whereby the drive member may be linearly displaced at a minimum of energy loss.

The distance between adjacent coils of the coil spring may be larger than the extension of the spring engagement member, in the direction parallel to the rotational axis. This also entails for a further decreased friction between the spring engagement member and the coil spring.

The spring engagement member may be fixed to the output shaft and project radially outwardly. This entails for embodiments where the coil spring is prevented from free rotation relative to the drive member.

Alternatively, the spring engagement member may be fixed to the drive member and project radially inwardly. This entails for embodiments where the coil spring is prevented from free rotation relative to the output shaft.

The coil spring may comprise at least one radially or tangentially projecting end leg. The end leg may be arranged to cooperate with a leg support or stop arranged at the drive member or at the output shaft to thereby limit or prevent relative rotation between the spring and the drive member or the output shaft respectively. By this means it is readily assured that the rotational movement of the spring engagement member or the coil spring is transformed to an axially linear displacement of the driving member.

The coil spring may comprise two end legs which are arranged at a respective end of the coil spring and essentially aligned in the axial direction of the coil spring. By this arrangement the coil spring is securely prevented from rotation relative the drive member or the output shaft over its entire length.

The at least one end leg may project outwardly and the drive member may comprise a first and a second leg support, which are arranged to allow a limited rotation of the coil spring relative to the drive member. At such embodiments, the coil spring is thus prevented from free rotation relative to the drive member and the spring engagement member is fixed to the output shaft, for transforming rotation of the spring engagement member into axial displacement of the coil spring and the driving member. By allowing a certain initial rotation of the coil spring at each drive cycle of the motor, the requirement of the starting torque of the motor may be reduced, whereby the dimensions and power consumption of the motor may be reduced.

The leg supports may be arranged to allow 30° to 350° and preferably approximately 180° rotation of the coil spring relative to the drive member. This entails for a simple and symmetric construction while still allowing a suitable reduction of the required starting torque of the motor.

The leg supports may be formed as a respective axially extending inner wall surface of the drive member. By this means a reliable and well defined support or stop for each leg is accomplished in a simple and space saving manner.

Alternatively, the at least one end leg may project inwardly and the output shaft may be provided with an axially extending slit which receives the at least one end leg. At such embodiments, the coil spring is thus prevented from free rotation relative to the output shaft and the spring engagement member is fixed to the drive member, for transforming rotation of the helical spring into axial displacement of the spring engagement member and the driving member.

The slit may have a circumferential extension such as to allow some limited rotation of the coil spring relative to the output shaft. Thereby, the starting torque of the motor may be reduced.

The output shaft may comprise a flexible portion arranged outside of the recess. This allows for that the motor may be arranged out of linearity with the rotational axis of the first element. By this means, the motor may be arranged in a portion of e.g. a handle neck, which portion is not aliened with the rotational axis such that the over all axial length of the handle device may be kept at a minimum.

The at least one engagement member may be radially displaceable in and out of simultaneous engagement with the first and second coupling member. By this means, a reliable releasable connection between the first and second coupling member may readily be achieved, while keeping the axial length of the coupling device at a minimum. This embodiment also allows for that the engagement member is subjected to compression load rather than shear load when a high torque is applied between the first and second element and the engagement member is in simultaneous engagement with the first and second coupling members. This in turn entails that the engagement member may withstand very high torques without failure.

Alternatively, the at least one engagement member may be arranged axially displaceable in and out of simultaneous engagement with the first and second coupling members. By this means a reliable connection between the first and second coupling member may be accomplished while keeping the radial dimension of the coupling device at a minimum. At such embodiments the engagement member may be arranged to be subjected to shear loads upon applying a torque to the first element. This may be advantageous e.g. if the engagement member should constitute a breakpin, which breaks at a specific torque being applied to the first element when the engagement member is in simultaneous engagement with the first and second coupling members.

The second element may be a rotational shaft connectable to a lock arrangement. Such an embodiment readily allows for a handle device wherein the release position of the at least one engagement member defines a locking state of the handle device by constituting a free swing mode.

Alternatively, the second element may be a stationary member which is fixable to a door, a window, a locker, a lock housing or the like. By this means a locked state of the handle device is accomplished in the engaged position of the at least one engagement member, which position prevents rotation of the first element and the manually actuable member.

Additional objects and advantages of the handle device appears from the following detailed description of exemplifying embodiments and from the appended claims.

BRIEF DESCRIPTION OF THE DRAWINGS

Below, a detailed description of exemplifying embodiments is given with reference to the attached drawings, in which.

DETAILED DESCRIPTION OF EXEMPLIFYING EMBODIMENTS

In this specification, the term handle refers to any type of manually manoeuvrable organ for operating a lock mechanism of a door, a window, a locker, a gate, a hatch or the like. Examples of such manually manoeuvrable organs are door handles, window handles, lever handles, thumb turns, knobs etc. Where not specified differently the terms axial, coaxial and radial refers to an axis of rotation by which the manually manoeuvrable organ may be rotated or pivoted.

In the attached drawings, FIGS. 1-6 illustrate a first embodiment of the invention comprising a first rotational element and a second stationary element and wherein an engagement member is radially displaceable in and out of simultaneous engagement with the first and second element.

Figure 7:
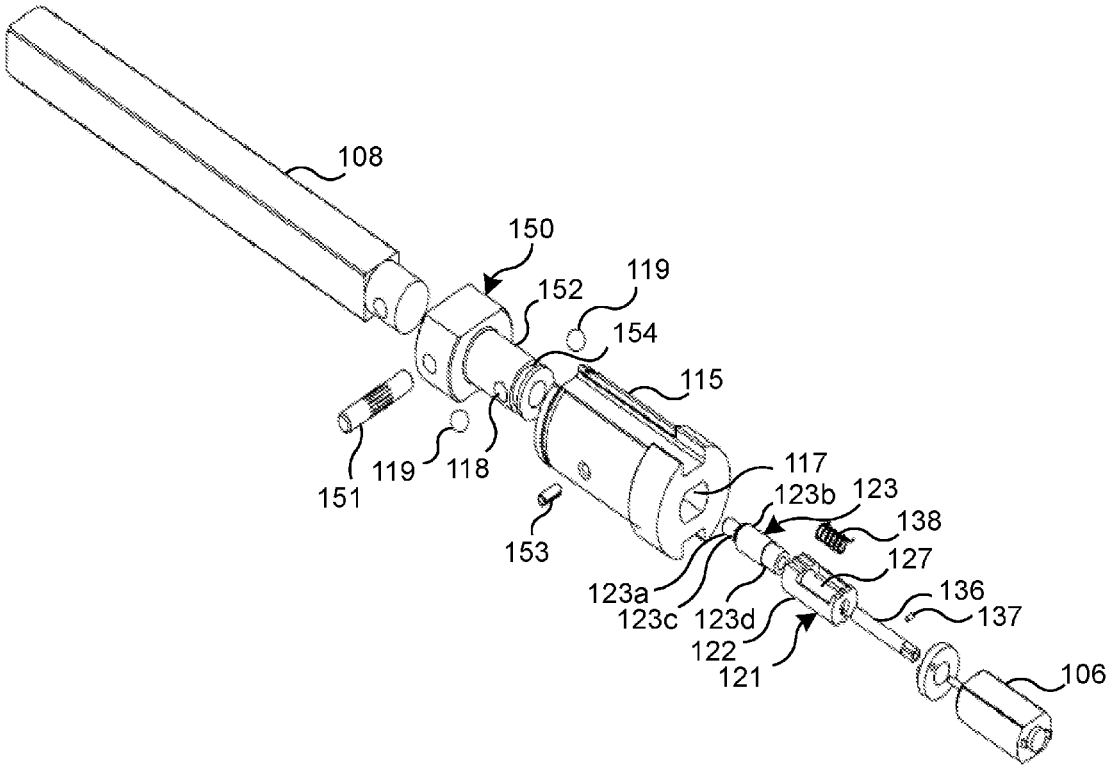
FIG. 7 is an exploded perspective view of a coupling device comprised in a handle device according to a second embodiment of the invention.
Figure 8:
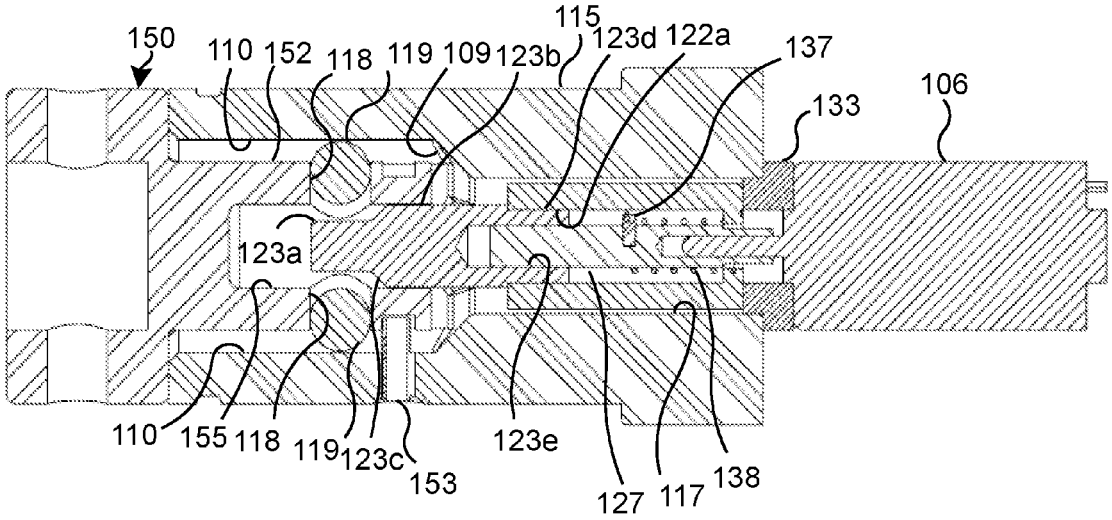
FIG. 8 is a longitudinal section through the coupling device shown in FIG. 7.

FIGS. 7-8 illustrate a second embodiment comprising a first rotational element and a second element which is also rotational, wherein an engagement member is radially displaceable in and out of simultaneous engagement with the first and second element.

Figure 9:
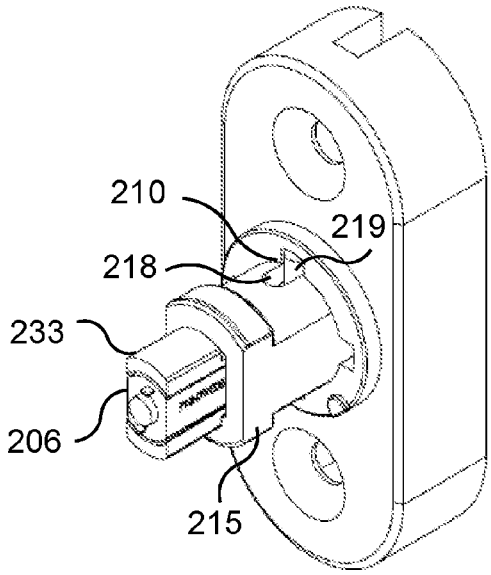
FIG. 9 is a perspective view of a coupling device comprised in a handle device according to a third embodiment of the invention.
Figure 10:
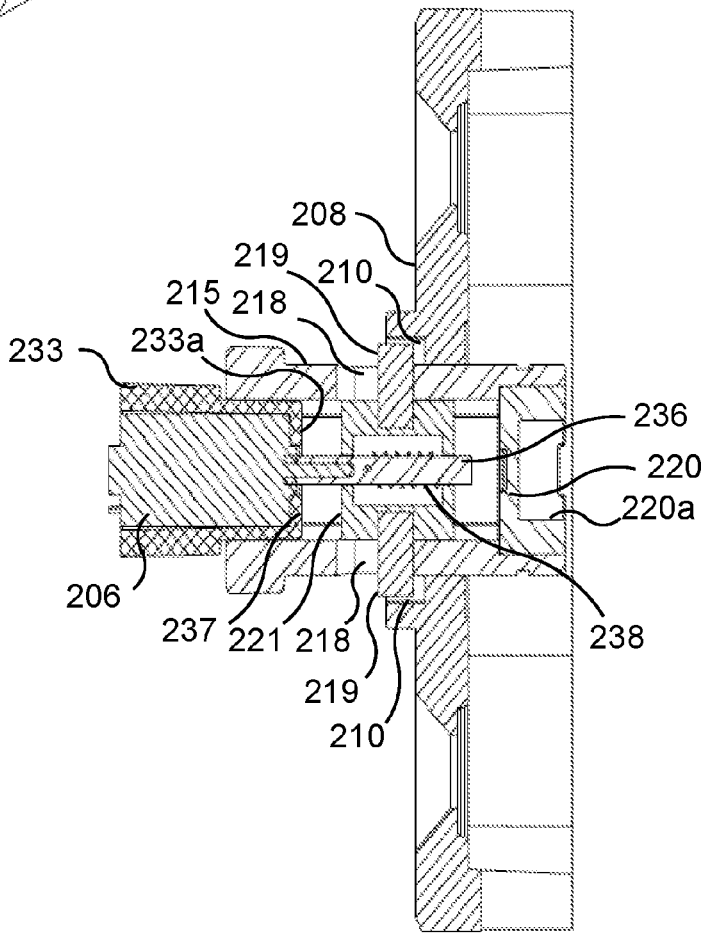
FIG. 10 is a longitudinal view of the coupling device shown in FIG. 9.

FIGS. 9-10 illustrate a third embodiment comprising a first rotational element and a second stationary element, wherein an engagement member is axially displaceable in and out of simultaneous engagement with the first and second element.

Figure 11:
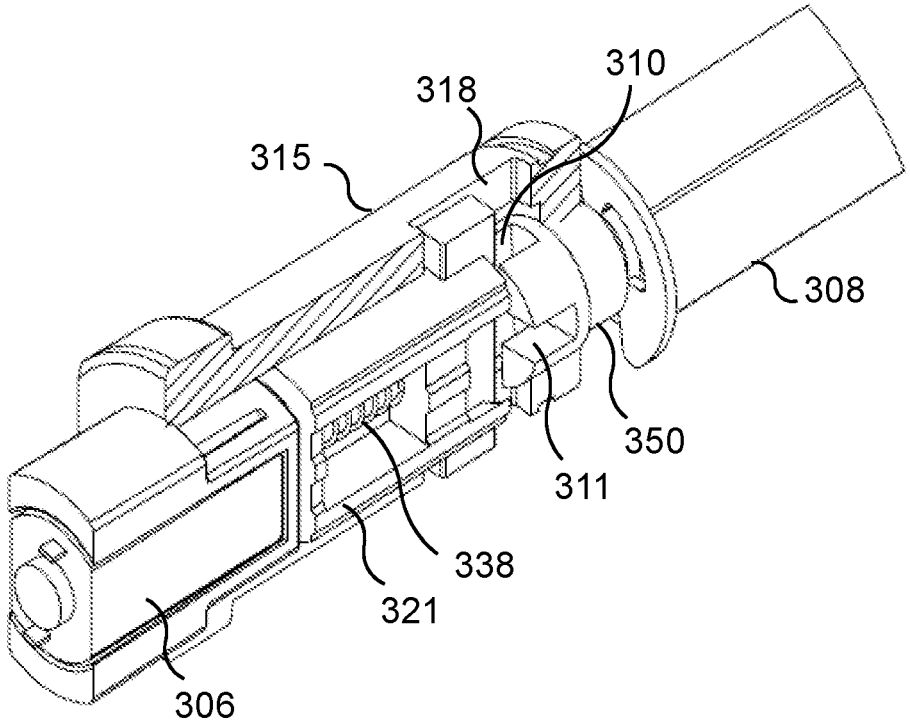
FIG. 11 is a perspective view, partly in section of a coupling device comprised in a handle device according to a fourth embodiment of the invention.
Figure 12:
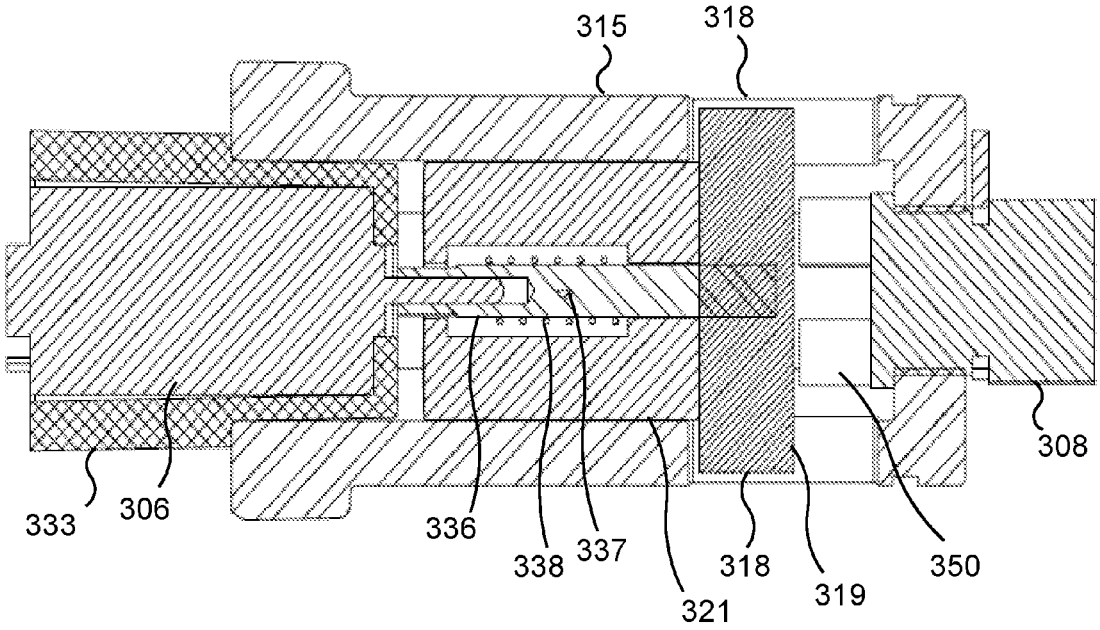
FIG. 12 is a longitudinal section of the coupling device shown in FIG. 11.

FIGS. 11-12 illustrate a fourth embodiment comprising a first rotational element and a second element which is also rotational, wherein an engagement member is axially displaceable in and out of simultaneous engagement with the first and second element.

Figure 13:
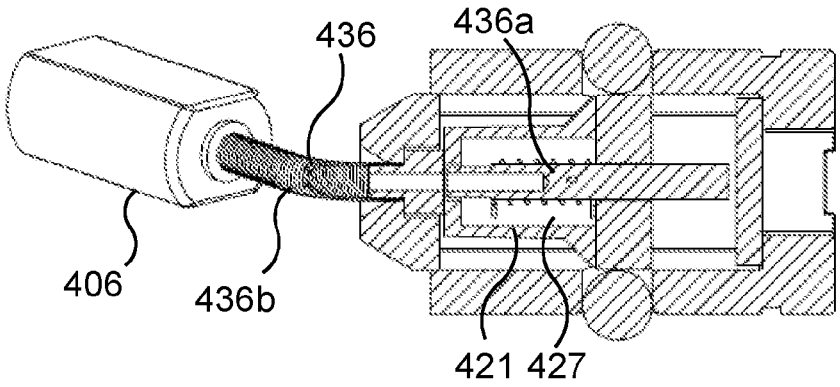
FIG. 13 is a view, partly in perspective and partly in longitudinal section illustrating some components of a coupling device comprised in a handle device according to a fifth embodiment of the invention.
Figure 14:
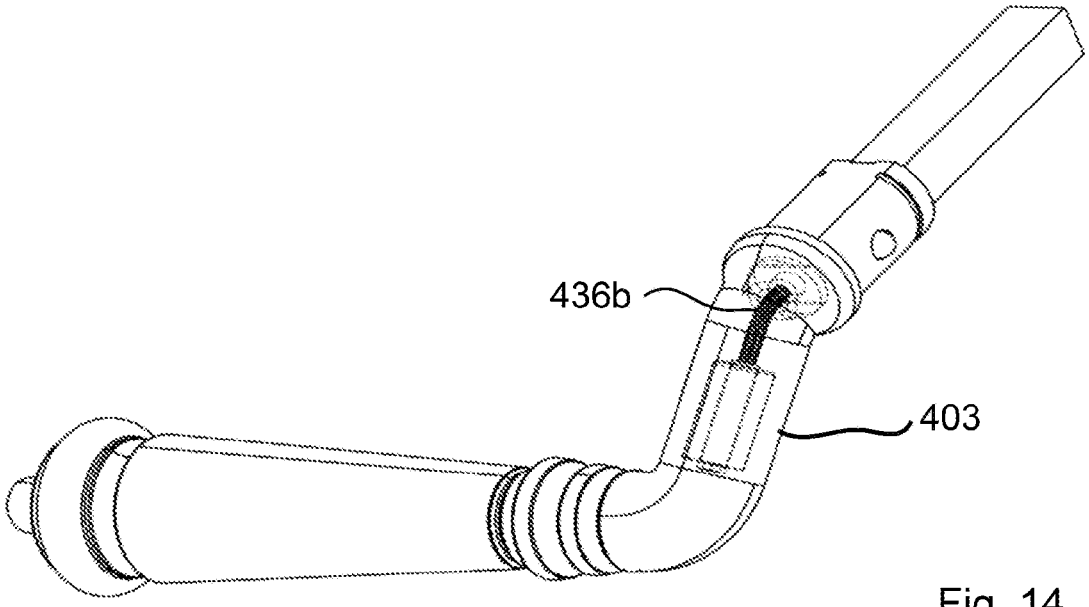
FIG. 14 is a perspective view illustrating some components of a handle device comprising the coupling device illustrated in FIG. 13.
Figure 15:
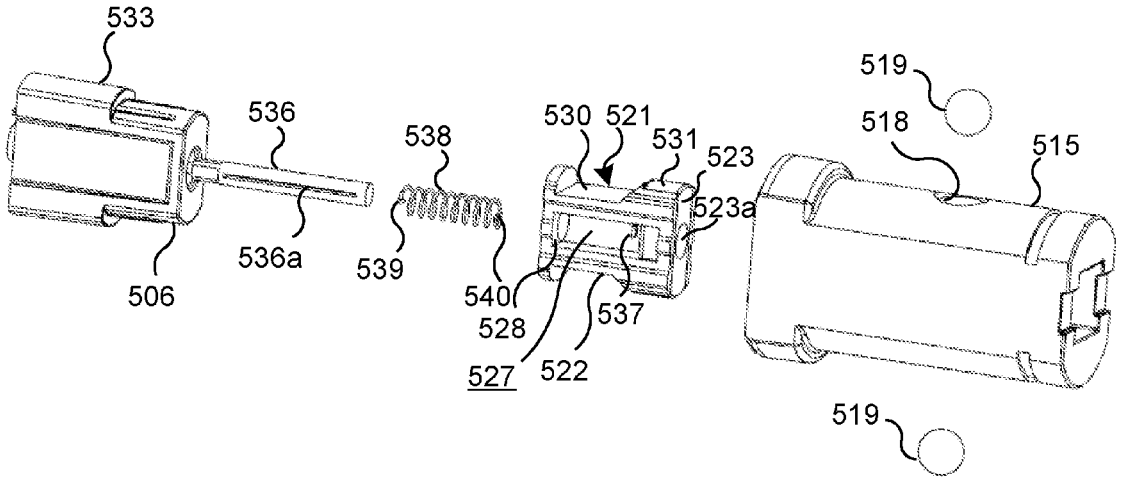
FIG. 15 is an exploded perspective view illustrating some components of a coupling device comprised in a handle device according to a sixth embodiment of the invention.
Figure 16:
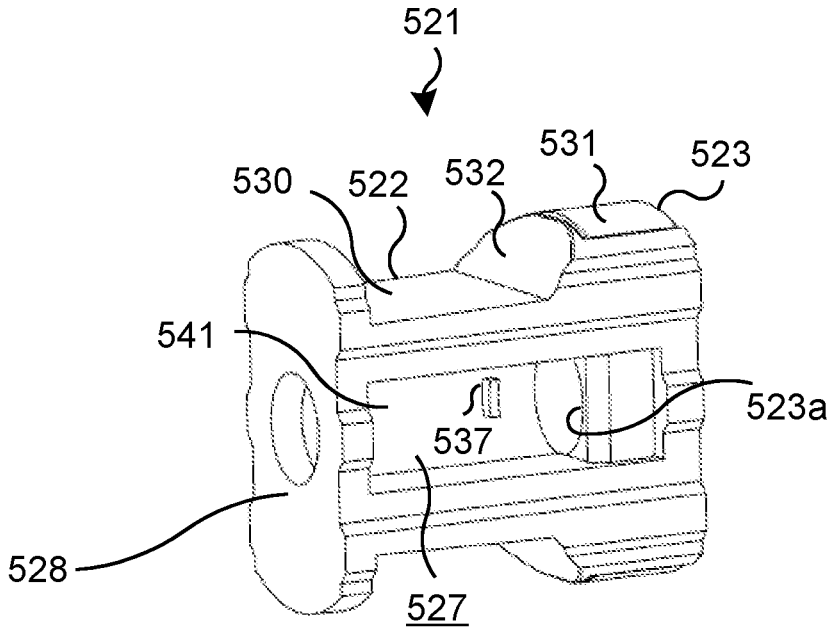
FIG. 16 is a perspective view in enlarged scale of a drive member comprised in the coupling device shown in FIG. 15.

FIGS. 13-14 illustrate a fifth embodiment which operates in accordance with the operating principle of the first embodiment.

FIGS. 15-18 illustrate some components of a sixth embodiment of the invention comprising a first rotational element and a second stationary element and wherein an engagement member is radially displaceable in and out of simultaneous engagement with the first and second element. At this embodiment the coupling device is inverted in relation to the above mentioned embodiments in the sense that the helical coil spring is fixed to the output shaft and the spring engagement member is fixed to the drive member instead of vice versa as in embodiments one to five.

The handle device according to the first embodiment shown in FIGS. 1-6 comprises a manually operational window handle 1 comprising a manually manoeuvrable member 2 which is formed as a grip portion of the handle. A first rotational element 3 forming a cylindrical neck portion of the handle 1 is rigidly connected with the manoeuvrable member 2. The handle 1 and its first element 3 is rotatable about an axis of rotation which extends centrally through and concentrically with the first element 3. A key pad comprising five push buttons 4 for entering an authorisation code is arranged at the manoeuvrable member 2. The push buttons 4 are electrically connected to an electrical control unit 5 received inside the manoeuvrable member 2, for verification of the authorisation code and control of an electrical motor 6, which will be described further below. An electrical battery 7*a* may be inserted in a battery cradle 7*b* which in turn may be inserted through the free end of the manoeuvrable member 2 and electrically connected to the control unit 5 for powering the control unit 5 and the motor 6.

The handle device also comprises a second element 8, which is arranged to be fixed to a frame (not shown) of a window, a French window or to a door or the like. The second element 8 is formed as a handle escutcheon or a handle plate and constitutes a stationary member. The second element 8 exhibits a central through opening 9. The opening 9 is generally cylindrical and exhibits two pairs of axially extending mutually opposing and radially arranged engagement recesses 10, 11. The second element 8 also exhibits two mounting holes 12 for reception of a respective mounting screw 13, by means of which the second element 8 may be fixedly attached to the frame or to the door. A cover plate 14 is attached to the second element 8 and arranged to conceal and prevent access to the mounting screws 13.

Figure 1:
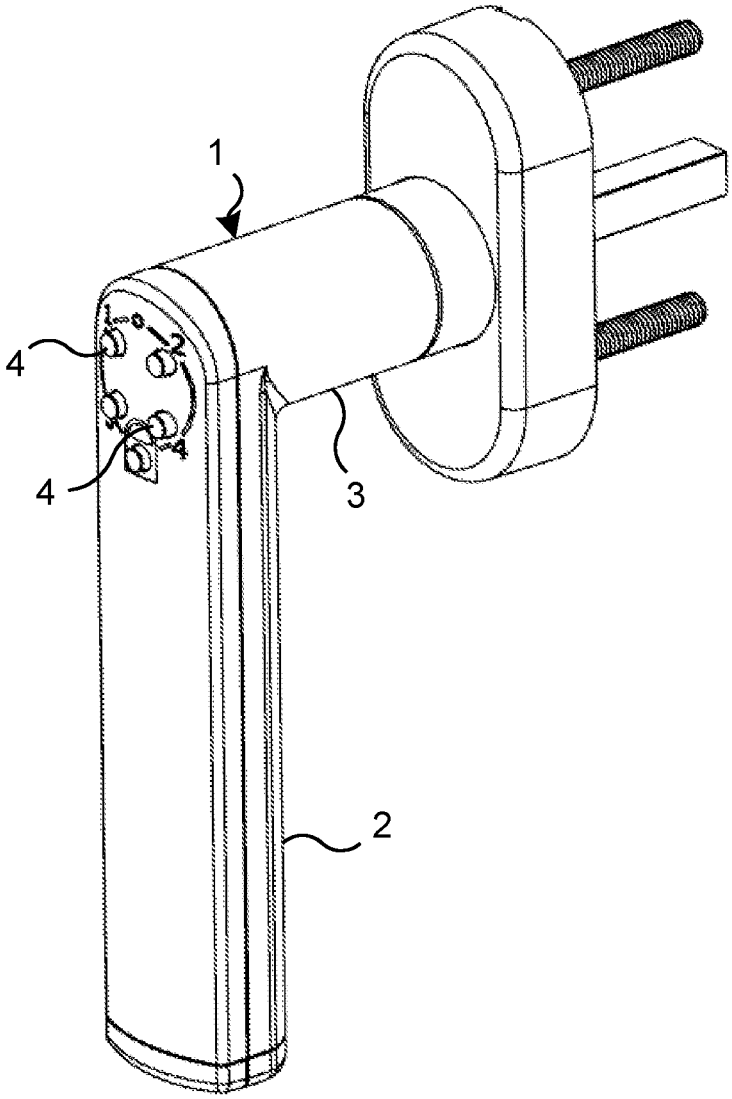
FIG. 1 is a perspective view of a handle device according to a first embodiment of the invention.
Figure 2:
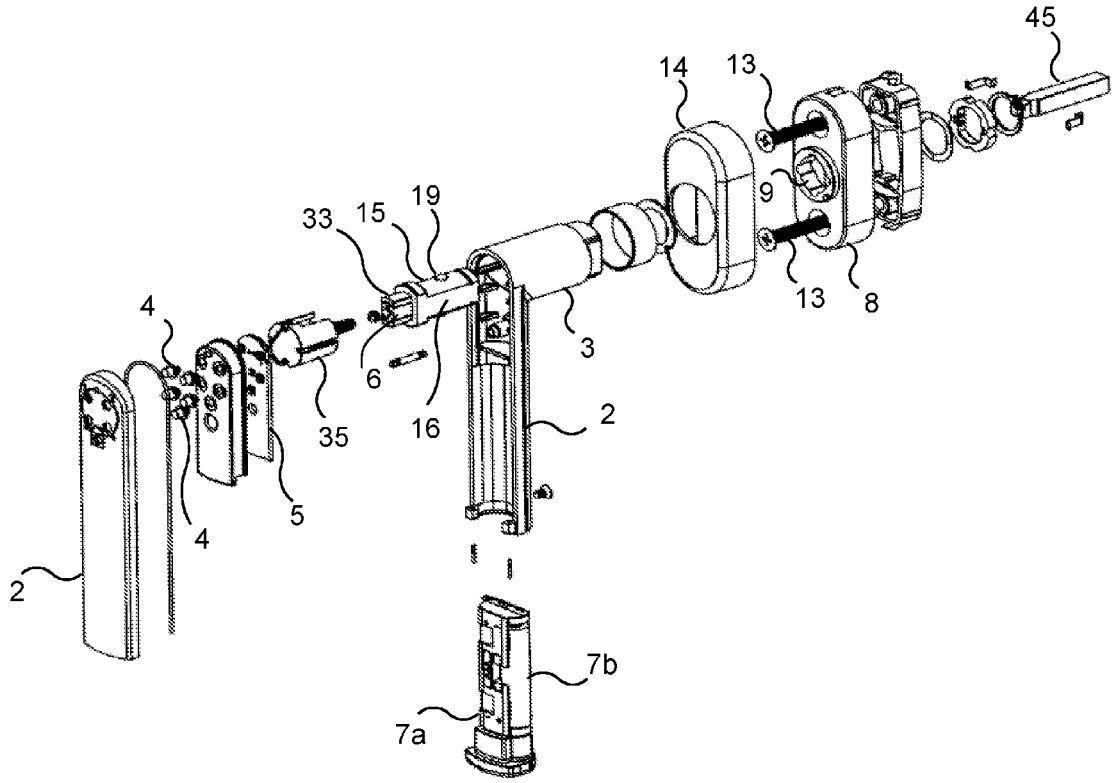
FIG. 2 is an exploded perspective view of the handle device shown in FIG. 1.
Figure 3:
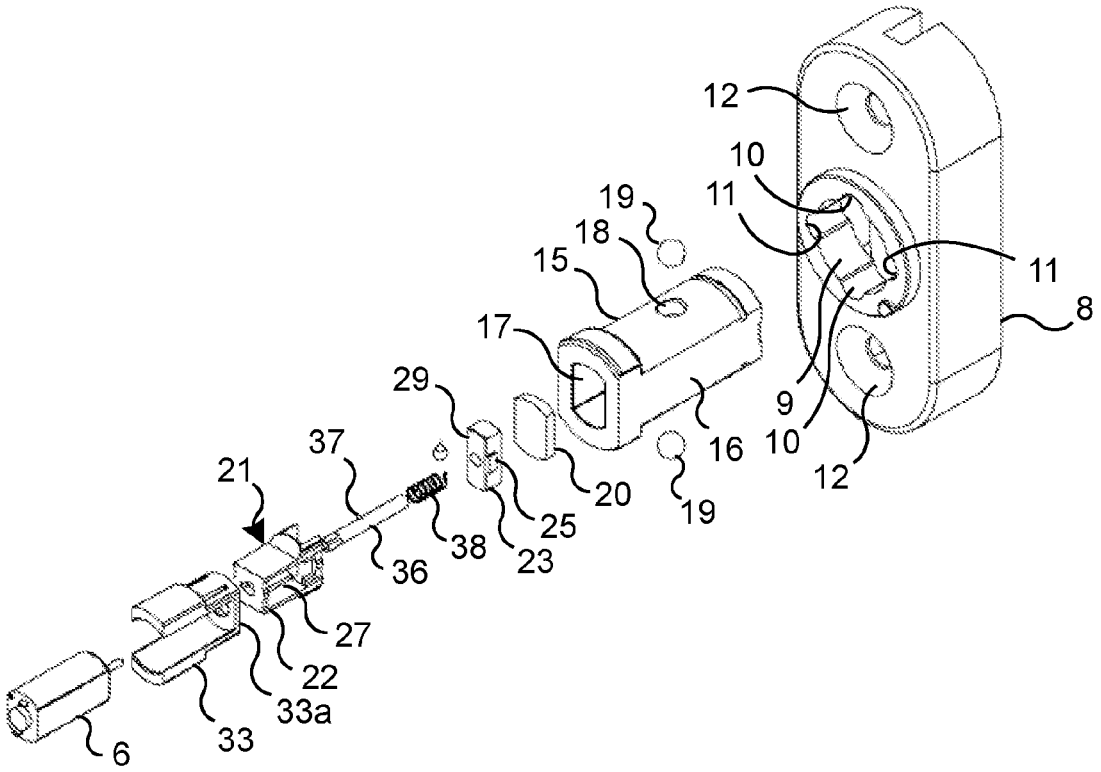
FIG. 3 is an exploded perspective view in enlarged scale showing a coupling device comprised in the handle device shown in FIG. 1.

As best seen in FIGS. 2 and 3, the handle device comprises a coupling device which is arranged to selectively allow and prevent the first element 3 and the handle 1 to rotate relative to the second element 8. The coupling device comprises a first coupling member 15 which forms a drive member housing. The first coupling member 15 is received in the first element 3 and provided with planar outer side surfaces 16, which in cooperation with corresponding inner planar surfaces (not shown) arranged inside the first element 3, prevents relative rotation between the first coupling member 15 and the first element 3. The first coupling member 15 exhibits a longitudinal through opening 17, which extends coaxially with the rotational axis. The through opening 17 exhibits two mutually opposed planar side surfaces. The first coupling member 15 also exhibits two mutually opposed engagement bores 18, each of which extends radially from the through opening 17 to the exterior of the first coupling member 15. A respective engagement member 19, in the form of a steel ball, is received in each engagement bore 18. A stop plate 20 is inserted in the through opening 17 and prevented from axial displacement in one direction by means of a waist portion 17*a* arranged in the through opening 17 (see FIG. 5*a*).

A drive member 21 is arranged axially displaceable in the through opening 17. The drive member 21 has a cross section which corresponds to the cross section of the through opening 17 such that rotation of the drive member 21 relative to the first coupling member 15 is prevented. The drive member 21 comprises a slide 22 made of polymer material and an engagement member stop element 23 which is made of a high strength material such as steel. The stop element 23 is received in an end recess 24 (see FIG. 6) arranged in the slide 22 and attached thereto by means of cooperating snap fit organs 25, 26 arranged at the stop element 23 and the slide 22 respectively. The drive member 21 exhibits an interior cavity or recess 27 which is arranged inside the slide 22. The interior recess 27 is delimited in both axial directions by a respective stop surface 28, 29. One stop surface 28 is formed of an interior end wall of the slide 22 and the other stop surface 29 is formed of an end surface, facing the slide 22, of the stop element 23 (see FIGS. 3, 5*a* and 6).

Figure 5A:
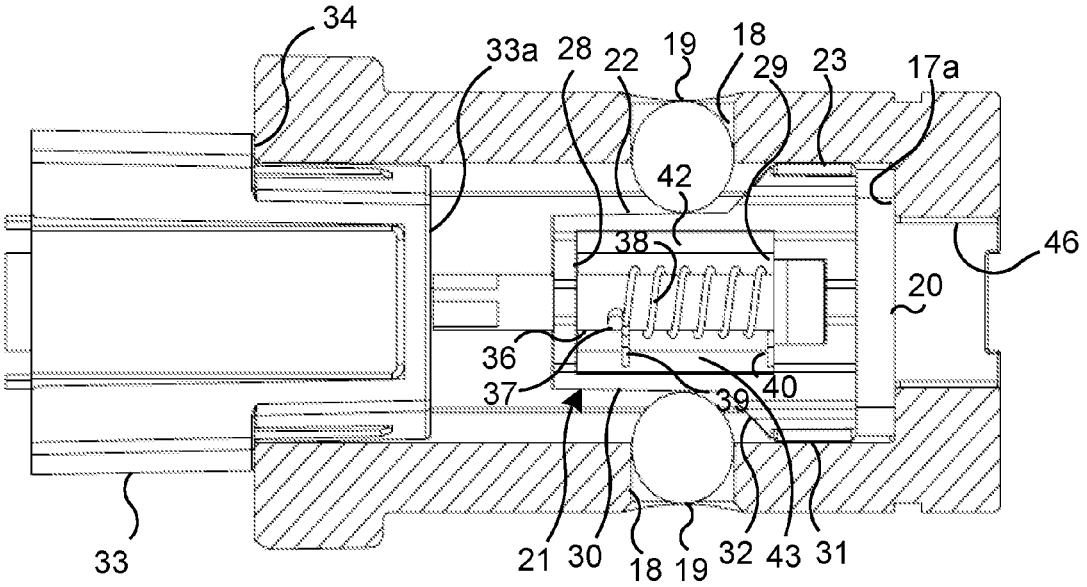
FIGS. 5*a*-5*c* are longitudinal sections of some components of the coupling device shown in FIG. 3 illustrating different operating positions of the components.
Figure 5B:
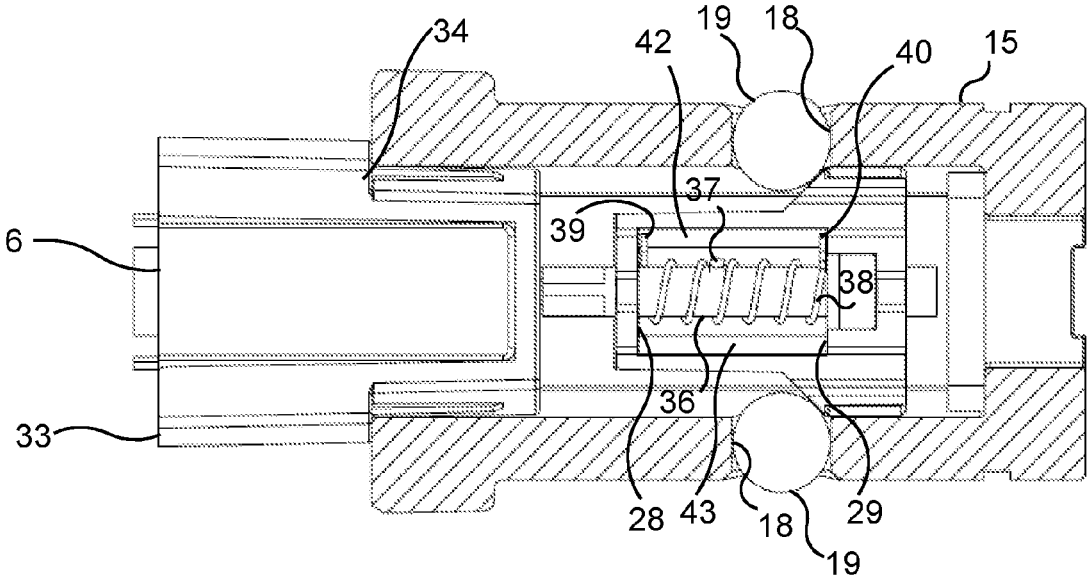
Figure 5C:
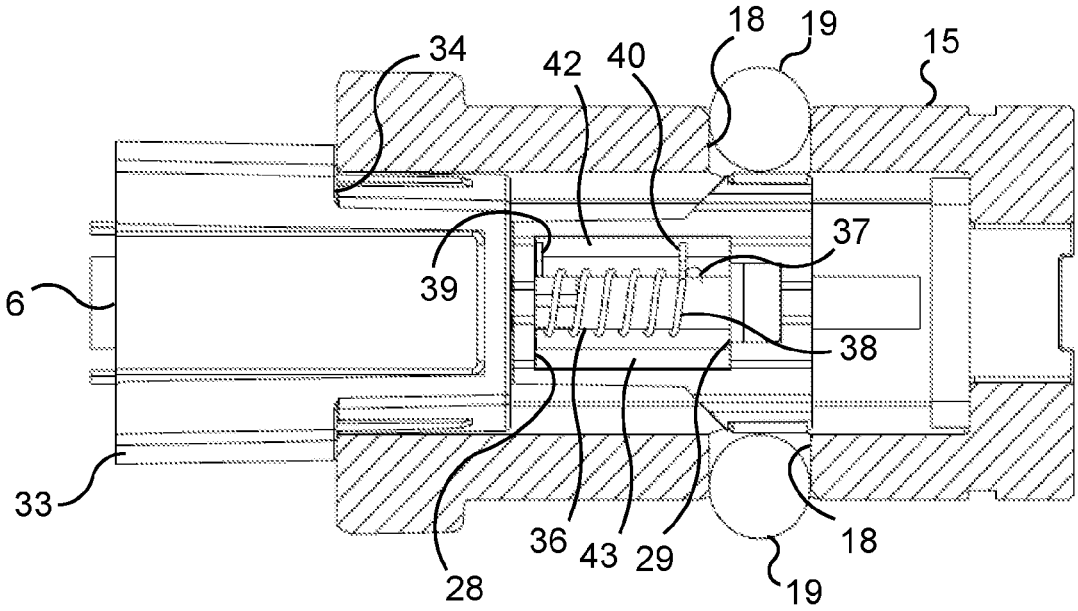

As best seen in FIGS. 5*a*-5*c*, the drive member 21 exhibits, over its axial extension, variable radial dimensions in a axial plane intersecting both engagement bores 18. Along a first axial portion 30 arranged at the slide 22, the drive member exhibits a smallest radial thickness in said plane. Along a second axial portion 31 arranged at the stop element 23 it exhibits a largest corresponding thickness. Along an intermediate axial portion 32 arranged between the first 3*o* and second 31 axial portions the corresponding outer surfaces of the slide 22 are tapering such as to connect the first 30 and second 31 portions.

The coupling device further comprises an electrical motor 6, which is received in a motor cradle 33. The motor cradle 33 is received in the through opening 17 of the first coupling member 15 and form fitted therein to prevent rotation of the motor cradle 33 and the motor 6 relative to the first coupling member 15. The motor 6 and the motor cradle 33 are prevented from axial movement relative to the first coupling member 15, by means of a shoulder 34 arranged at the cradle (see FIG. 5*a*) and an end cap 35 which is fixed around an axial end portion of the first coupling member 15 (see FIG. 2). An axial end wall 33*a* of the motor cradle 33, which is arranged at the opposite side of the drive member 21 as seen from the stop plate 20, forms a stop for the drive member 22.

The motor 6 is provided with a rotational output shaft 36 which extends coaxially with the rotational axis, through corresponding through openings arranged in the motor cradle 33, the slide 22 and the stop element 23. The output shaft 36 is provided with a spring engagement member 37, which in this embodiment is formed as radially extending pin which is securely fixed to the shaft 36. In the shown embodiment the pin 37 is cylindrical. A helical coil spring 38 is arranged around the output shaft 36 and in the interior recess 27 of the drive member 21. The helical spring 38 is an open wounded and open ended compression spring with a coil pitch that is larger than the diameter of the pin 37. The radial extension of the pin 37, from the rotational axis of the shaft 36 and the first element 3 is larger than the coil radius of the spring 38. The spring is provided with two radially extending end legs 39, 40.

Figure 6:
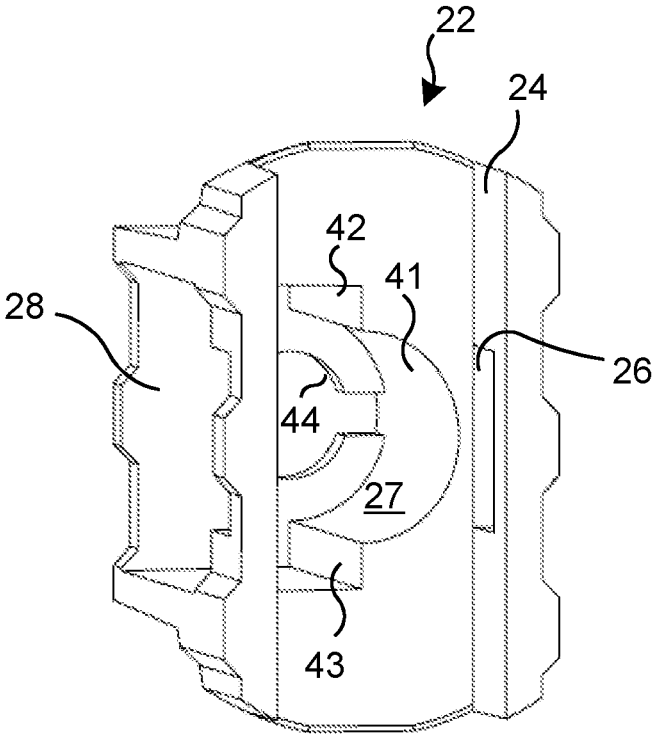
FIG. 6 is a perspective view of a drive member comprised in the handle device according to the first embodiment.

As best seen in FIG. 6, the slide 22 of the drive member 21 exhibits internal wall surfaces 41, 42, 43 which radially delimit the interior recess 27 and extend axially over the entire length of the recess 27. The internal wall surfaces comprises a semi cylindrical portion 41 which accommodates a radial portion of the helical spring 38 and two planar leg support surfaces 42, 43 which are mutually parallel and arranged radially opposite to each other.

The end wall of the slide forming the stop surface 28 exhibits a key shaped through opening 44 which, during assembly, allows insertion of the output shaft 36 with the radial pin 37 and through which the output shaft extends when mounted.

Figure 4:
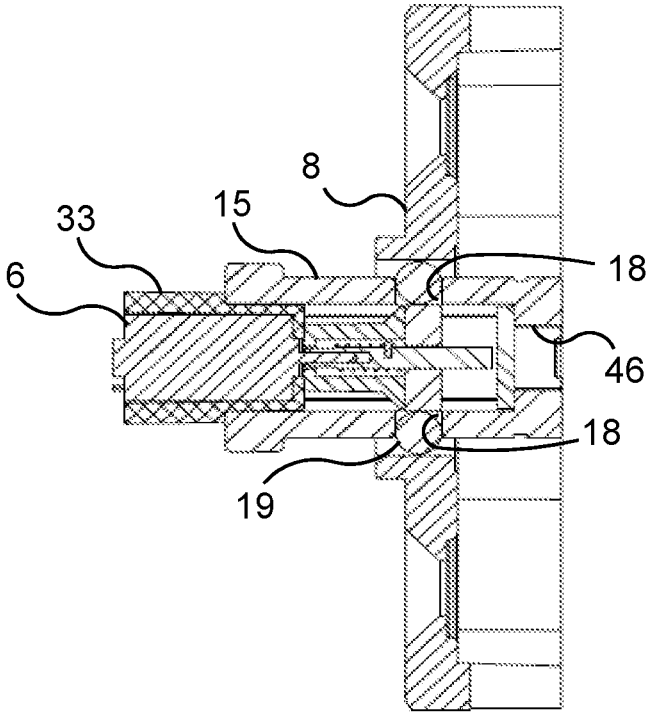
FIG. 4 is an longitudinal section through the coupling device shown in FIG. 3.

With reference to FIGS. 2 and 4, the handle device according to the first embodiment comprises a plain spindle 45 which is inserted in a square hole 46 in the first coupling member 15, such that rotation of the first coupling member 15 is transmitted to the plain spindle 45. The plain spindle 45 may be connected to a follower or any other operational member of a lock arrangement for, upon rotation, accomplishing an operational movement of a lock bolt or any similar locking member.

With reference primarily to FIGS. 5*a*-5*c* the operation of the handle device according to the above described first embodiment will now be explained.

In FIG. 5*a* the drive member 21 is positioned in a first end position. In this position the first axial portion 3*o* of the drive member 21, having the smallest radial thickness, is aligned with the engagement bores 18. The engagement members 19 are thereby allowed to be radially withdrawn, such that they do not protrude radially outside of the first coupling member 15. In this position the radial pin has been rotated in a first rotational direction such that it has been brought out of engagement between any two adjacent coils of the helical coil spring 38. Instead, the pin 37 bears against the outer side of an end coil of the spring 38 and the spring is thereby compressed such as to exert an pretension force to the drive member 21, via the stop surface 29, against which the opposite end portion of the spring 38 is supported. The pretension force exerted by the compressed spring 38 presses the drive member 21 to the right as seen in FIG. 5*a*. In this position the drive member 21 is supported by the stop plate 20. In the position shown in FIG. 5*a*, the two end legs 39, 40 of the spring bears against the lower (as seen in the figure) leg support surface 43. The first coupling member 15, and thereby the first rotational element 3 and the entire handle are in this position allowed to rotate relative to the second element 8 forming a handle escutcheon. In this position, the handle 1 may thus be used for manually operating any lock member which is connected to the plain spindle 45 and the handle device may thus be said to be in an unlocked state of operation.

When the handle device is to be switched to a locked state of operation, a user activates the electrical motor by pushing one or several buttons 4 of the key pad. The electrical control unit 5 may or may not be arranged to require an authorisation code to be given before allowing activation of the motor 6. Upon activation of the motor, the output shaft 36 is rotated in a rotational direction which corresponds to initially moving the radial pin 37 upwardly, as seen in FIG. 5*a*. During the initial rotation of the output shaft 36, the leftmost spring coil is somewhat more compressed than the other coils of the spring 38. Thereby, rotation of the pin 37 in contact with the leftmost spring coil will apply a driving force component acting in the direction of the normal to the end legs 39 extension. This, in combination with the frictional engagement between the pin 37 and the spring 38, will surmount the frictional force between the spring's rightmost coil and the stop surface 29. This in turn will cause the spring 38 to rotate relative to the drive member 21, until the two end legs 39, 40 of the spring are brought into bearing contact with the upper (as seen in the figure) leg support surface 42. The spring 38 is thus allowed to rotate 180° relative to the drive member 21 during the initial rotation of the output shaft 36. This reduces the required starting torque of the motor to thereby allow reduced motor dimensions and power input.

When the end legs 39, 40 have come into bearing contact with the leg support surface 42, continued rotation of the shaft 36 will cause the radial pin 37 to engage the spring 38 by entering between adjacent coils of the spring 38. The output shaft 36 and the pin 37 are constantly maintained at the same axial position and the engagement of the pin between consecutive coils of the spring 38, will first allow the spring to be extended and relaxed such that the left end of the spring 38 (as seen in the figures) comes into supporting contact with the stop surface 28. Further continued rotation of the pin 37, will then cause the spring 38 to exert an axial force onto stop surface 28, such that the drive member 21 is displace axially to the left as seen in FIGS. 5*a*-5*c*. During this axial displacement of the drive member 21, the intermediate portion 32 of the drive member will pass the engagement bores 18 and in contact with the engagement members 19 press these radially outwards as may be seen in FIG. 5*b*. Further continued rotation of the output shaft 36 and the pin 37 will lead to a continued axial displacement of the drive member 21 until the drive member 21 comes into bearing contact with the end wall 33*a* of the motor cradle 33. When the drive member 21 by this means is prevented from further axial displacement, continued rotation of the shaft 36 will cause compression of the spring 38 such that it exerts an increased pretension force to the stop surface 28 and the drive member, in the leftward direction as seen in FIG. 5*c*. The pretension force will increase until the pin 37 is brought out of engagement between adjacent coils of the spring 38. In this position, which is illustrated in FIG. 5*c*, the pin 37 will maintain the reached pretension force by bearing against an end portion of the spring 38 also after termination of the rotation of the output shaft 36. At this position, the second portion 31 of the drive member 21 has been brought in alignment with the engagement bores 18 to thereby displace and maintain the engagement members to their fully radially outwardly protruding positions. The engagement members 19 have thereby reached a position at which they are in simultaneous engagement with both the engagement bores 18 of the first coupling member and with the recesses 10 or ii of one pair, depending on the rotational position of the handle 1, of the recesses arranged in the second element 8. During such simultaneous engagement the first coupling member 15 and thereby the first element 3 and the entire handle are prevented from rotating relative to the second element 8. The plain spindle 45 may thus not be rotated for operating a lock bolt or the like and the handle device has thereby assumed a locked state of operation.

It should be noted that, in the simultaneous engagement position of the drive member 21, the engagement members 19 are radially inwardly supported by the high strength stop element 23 of the drive member 21. The engagement members 19 will thereby be maintained in the outwardly displaced simultaneous engagement position even if a great torque is applied to the handle in an attempt to force the engagement members 19 radially inwards and out of engagement with the second stationary element 8. It should also be noted that, in this embodiment just as in embodiment two and six, the engagement member is subjected to compression load when a torque is applied to the handle in the simultaneous engagement position. By this means the engagement member is able to withstand very high torques without the risk of material failure.

Further, if during rotation of the output shaft 36 for driving the drive member 21 and the engagement members 19 to the simultaneous engagement position, the engagement bores 18 are not aligned with a respective pair of engagement recesses 10, 11 or if the engagement member is obstructed in any other way, the output shaft 36 and the pin 37 may still be rotated such that the pin 37 is brought out of engagement with the coil spring 38 at the corresponding end of the coil spring. The pin 37, bearing against the end of the coil spring 38, will then create and maintain an increased pretension of the spring and the drive member 21 in the direction towards the simultaneous engagement position, also after the motor 6 has stopped rotating. As soon as the engagement bores 18 have been aligned with the engagement recesses 10, 11 or the obstacle to the engagement member 18 has been removed, the drive member 21 may complete its axial displacement to the simultaneous engagement position shown in FIG. 5*c* by means of the increased pretension of the coil spring 38 and without any additional rotation of the motor 6.

When the handle device is to be unlocked for allowing operation of the lock bolt or the like, the user inserts an authorized code via the key pad whereby the electric control unit activates the motor 6 to rotate in the rotational direction which is opposite to the one for displacing the engagement members 19 radially outwards. The engagement between the radial pin 37 and the spring 38 is then carried out in the reversed direction as described above and the drive member 21 is displaced in the opposite axial direction until it again reaches the position shown in FIG. 5*a*. In this position the engagement members 19 may readily be brought out of engagement with the second element 8 by lightly pivoting the handle 1 and the first coupling member 15, whereby the semi cylindrical shape of the engagement recesses 10, 11 in cooperation with the spherical shape of the engagement members 19 will push the engagement members 19 radially inwards and out of engagement with the recesses 10, ii of the second element 8.

Since the radial pin 37 may be rotated out of engagement between adjacent coils of the spring 38 while still causing a pretensional force in the desired direction on the drive member, the motor may be actuated for rotation for a longer period of time than what is required for the helical spring to travel from one end to the other relative to the pin 37. This greatly facilitates the control of the motor 6, since it is sufficient to set the rotational time for each activation of the motor to any predetermined period of time which is longer than the minimum period of time necessary for accomplishing a full axial travel distance of the drive member relative to the radial pin 37.

FIGS. 7 and 8 illustrate a coupling device comprised in a handle device according to the second embodiment of the invention. At this embodiment the first element (not shown) and the second element 108 are rotational about a common rotational axis. As in the first embodiment, the first element is constituted by a handle neck (not shown) which is connected to a manually manoeuvrable handle grip portion (not shown). The second element 108 is constituted by a rotational plain spindle which may be connected to a lock bolt (not shown) or the like. A first coupling member 115 is arranged in the handle neck. Relative rotation between the handle neck and the first coupling member 115 is prevented by form locking. The second element 108 is connected to a second coupling member 150 by means of a radial peg 151 extending through radial holes in the second element 108 and the second coupling member 150.

Two radially displaceable engagement members 119 in the form of steel balls are arranged in radial engagement bores 118 extending from the outside to a centrally arranged axially extending cylindrical bore 155, in a cylindrical portion 152 of the second coupling member 150. The cylindrical portion 152 is received in a generally cylindrical axial bore 109 arranged in the first coupling member 115. A radial fixation pin 153 extending through the first coupling member 115 into a circumferential groove 154 in the cylindrical portion 152 prevents axial displacement of the second coupling member 150 relative to the first coupling member 115. The cylindrical bore 109 exhibits two radially opposed axially extending engagement recesses no. The engagement members 119 may be brought in and out of simultaneous engagement with the first 115 and second 150 coupling members. When in simultaneous engagement, the engagement members 118 have been displaced radially outwardly such that they engage both a respective engagement bore 118 and a respective engagement recess 110.

The coupling device also comprises an axially displaceable drive member 121 which is received in an axially extending drive member cavity 117 arranged in the first coupling member 115. The drive member 121 comprises a slide 122 and a engagement member pusher 123. The pusher 123 is arranged as an axial extension of the slide 122 and is received in the cylindrical bore 155. The pusher 123 comprises a first cylindrical portion 123*a* with a smallest diameter, a second cylindrical portion 123*b* with a largest diameter, which corresponds to the inner diameter of the cylindrical bore 155, and an intermediate conical portion 123*c* connecting the first 123*a* and the second 123*b* portions. The pusher 123 is journalled to the slide 122 by means of a fourth cylindrical portion 123*d* which is received in a corresponding hole 122*a* in an end wall of the slide 122. A shaft recess 123*e* extends axially and centrally through the fourth cylindrical portion 123*d*.

As in the first embodiment the coupling device also comprises an electrical motor 106, having an output shaft 136 with a radial pin 137. The output shaft 136 extends coaxially with the rotational axis of the first element through a through opening arranged in an end plug 133, through the interior recess 127 of the drive member's 121 slide 122 and further into the shaft recess 123*e*. A helical coil spring 138 is arranged in the interior recess 127 around the output shaft 136. End portions of the spring 138 may bear against stop surfaces arranged at an end wall of the slide 122 and at an end surface of the pushers 123 fourth portion 123*d*.

Also as in the first embodiment the drive member 121 may be displaced in either axial direction by rotating the output shaft in a corresponding rotational direction such that the radial pin 137, in engagement with the spring 138, brings about axial displacement of the drive member 121.

When the drive member 121 is positioned such that the first portion 123*a* of the pusher 123 is aligned with the engagement bores 118, the engagement members 119 may be displaced radially inwardly, and out of engagement with the engagement recesses 110 of the second coupling member 150. The first coupling member 115 is thereby disconnected from the second coupling member, whereby the handle and the first coupling member may be freely rotated without effecting any rotation of the second coupling member or the second element 108. The handle device is then in a locked state.

By rotating the output shaft 136 and the radial pin 137, such that the drive member 121 is displaced to the left as seen in the drawings, the intermediate portion 123*c* of the pusher will, in contact with the engagement members 119, push the engagement members radially outwards, such that they are brought into simultaneous engagement with both the radial engagement bores 118 and the axial engagement recesses no in the second coupling member. Further rotation of the output shaft 136, will bring the second portion 123*b* in alignment with the engagement bores 118 such that the engagement members 119 are securely held in simultaneous engagement. Thereby, the handle device has been unlocked and the handle may be manually operated in order to bring about an operational movement of the lock member being connected to the second element 108.

At this embodiment, the pusher 123 being arranged as an axial extension of the slide allows for a reduction of the radial dimension of the drive member 121. Thereby the radial dimension of the entire coupling device and the handle device may be kept at a minimum.

In the embodiment illustrated in FIGS. 9 and 10 the handle device comprises a first rotational element, such as a handle (not shown) and a second element 208 which is stationary fixed to a door, a window or the like. The coupling device comprises a first coupling member 215 which is fixed to the first element and a drive member 221 which is axially displaceable, coaxially with the rotational axis of the first element, inside the first coupling member 215. Two engagement members 219 are arranged as radially opposing engagement pins which are fixed to the drive member 221 and which projects radially outwards from a respective exterior surface of the drive member 221. The engagement members also extend radially outwards through a respective axially extending engagement member slit 218 in the first coupling member 215. The second element 208, which also constitutes a second coupling member, is provided with two corresponding radially opposed engagement recesses 210.

Just as in the first and second embodiments, the coupling device further comprises an electrical motor 206 having an output shaft 236 with a radial pin 237 and a helical spring 238 which is arranged around the output shaft and in an interior space 227 of the drive member 221. An end wall 233*a* of a motor cradle 233 limits the axial movement of the drive member 221 in one direction. In the opposite direction, the axial movement of the drive member 221 is limited by the corresponding end of the slit 218, which forms a stop for the engagement member 219, as illustrated in FIG. 10. Alternatively, in case the slit is extended to the right, as seen in the figure, axial movement of the driving member 221 could be limited by a stop plug 220 arranged in the first coupling member 215. The stop plug 220 is further provided with at square recess 220*a* for receiving a plain spindle (not shown) which may be connected to a lock bolt or another operative lock member (not shown). When the drive member 221, by rotating the shaft 236 as described above, is displaced axially to the right as seen in the drawings, the engagement members are axially displaced into simultaneous engagement with both a respective engagement member slit 218 and a respective engagement recess 210. The first coupling member 215 and the handle is thereby prevented from rotating and the handle device has assumed a locked operational mode.

Upon rotation of the output shaft 236 in the opposite direction, the drive member 221 is displace to the left as seen in the drawings, whereby the engagement members 219 are withdrawn from their engagement with the respective engagement recess 210. The handle device has then assumed an unlocked operational mode and the handle may be rotated for bringing about rotation of the plain spindle in order to operate any lock member connected thereto.

At the embodiment shown in FIGS. 11 and 12, the first element forming a handle (not shown) and the second element 308 are both rotational. The second element 308 constitutes a plain spindle which may be connected to a bolt or the like. A first coupling member 315 receives interiorly a drive member 321 which is axially displaceable by means of a motor 306, arranged in a motor cradle 333, an output shaft 336 with a radial pin 337 and a helical coil spring 338, as described above. The first coupling member 315 is provided with two radially opposed, axially extending engagement member slits 318. A single rod shaped engagement member 319 with rectangular cross section is fixed at an end portion of the drive member 321. The engagement member 319 extends radially into both engagement member slits 318. The second element 308 is connected to a second coupling member 350, which is provided with two pairs of radially opposed engagement recesses 310, 311.

Upon rotation of the motor in one direction, the drive member 321 is displace axially to the right in the drawings whereby the engagement member 319 is brought into engagement with one pair of engagement recesses 310 or 311. Since the engagement member 319 is constantly in engagement with the engagement slits 318, this displacement brings the engagement member 319 in simultaneous engagement with both the first 315 and the second 350 coupling member, such that the handle device is unlocked and the handle may be used for operating the bolt via the second element 308. When the motor is rotated in the opposite direction, the drive member 321 is displace away from the second coupling member 350 and the engagement member 319 is brought out of engagement with the engagement recesses 310, 311, such that the first coupling member 315 and the handle may be freely rotated without producing any rotational movement of the second element 308. Thereby the handle device assumes a locked state.

FIGS. 13 and 14 illustrates a fifth embodiment, wherein the coupling device comprises an output shaft 436 connected to the motor and exhibiting a rigid shaft portion 436*a* which extends through the interior recess 427 of the drive member 421. The output shaft 436 also comprises a flexible shaft portion 236*b* which is arranged between the motor 406 and the rigid shaft portion 436*a*. As illustrated in FIG. 14 this arrangement allows for that the motor does not need to be arranged in line with the rotational axis of the handle or the first element. By this means the axial length of the handle device may be greatly reduced, especially when the handle has a neck portion 403 that is arranged non parallel with the rotational axis of the handle.

FIGS. 15-18 illustrate a coupling device which forms part of a handle device according to a sixth embodiment of the invention. This coupling device may be said to be inverted in relation to the coupling devices comprised in the embodiments one to five as described above. Instead of comprising a rotating spring engagement member which is fixed to the output shaft and a helical coil spring that is fixed for limited rotation to the drive member, at this embodiment, the spring is fixed for limited rotation to the output shaft and the spring engagement member is fixed to the drive member.

The coupling device comprises a motor 506 which is accommodated in a motor cradle 533. The motor cradle 533 and the motor 506 are fixedly inserted in a longitudinally extending through opening 517 of a first coupling member 515 exhibiting engagement bores 518 with engagement members 519. A stop plate 520 is inserted in the through opening 517 and bears against a waist portion 517*a*. A drive member 521 is arranged axially displaceable in the through opening 517, between the stop plate 520 and a front end of the motor 506. The motor 506 and the stop plate 520 forms axial stop surfaces, limiting the axial movement of the drive member 521.

The drive member comprises a slide 522 with an internal recess 527 and a stop element 523. The drive member 521 exhibits, over its axial extension, variable radial dimensions in an axial plane intersecting both engagement bores 518. Along a first axial portion 530 arranged at the slide 522, the drive member exhibits a smallest radial thickness in said plane. Along a second axial portion 531 arranged at the stop element 523 it exhibits a largest corresponding thickness. Along an intermediate axial portion 532 arranged between the first 530 and second 531 axial portions the corresponding outer surfaces of the slide 522 are tapering such as to connect the first 530 and second 531 portions.

The motor 506 exhibits an output shaft 536 which extends into the interior recess 527 through an opening in the slide's 522 end wall 528. The stop element 523 exhibits a corresponding opening 523*a*, through which the output shaft 536 may extend when the drive member 521 has been displaced towards the motor 506. The output shaft 536 is provided with an axially extending slit 536*a*. A helical coil spring 538 is arranged around the output shaft 536. The outer diameter of the coil spring is smaller than the diameter of the opening in wall 528 and the opening 523*a*. The coil spring 538 is open wounded, open ended and provided with radially inwardly projecting end legs 539, 540. The end legs 539, 540 are aligned axially and received in the slit 536*a* of the output shaft 536. Thereby, the coil spring 538 is prevented from rotating relative to the output shaft 536. Each end leg 539, 540 is axially displaceable in the slit 536*a* and the axial length of the slit 536*a* is greater than the axial length of the coil spring 536, when in an unloaded state. The entire coil spring 538 and respective end portions thereof is thereby axially displaceable along the slit 536*a*.

An axially extending interior wall 541 of the drive member 521 is provided with a radially inwardly projecting spring engagement member 537. The spring engagement member 537 is able to engage the coil sprig 538 by being inserted between adjacent coils of the coil spring 538. In the shown example, the spring engagement member is formed as an inwardly projecting stud. The spring engagement member may however be formed in many other ways, as long as it is able to reach in between adjacent coils of the coil spring 538 to thereby engage the coil spring.

Figure 17A:
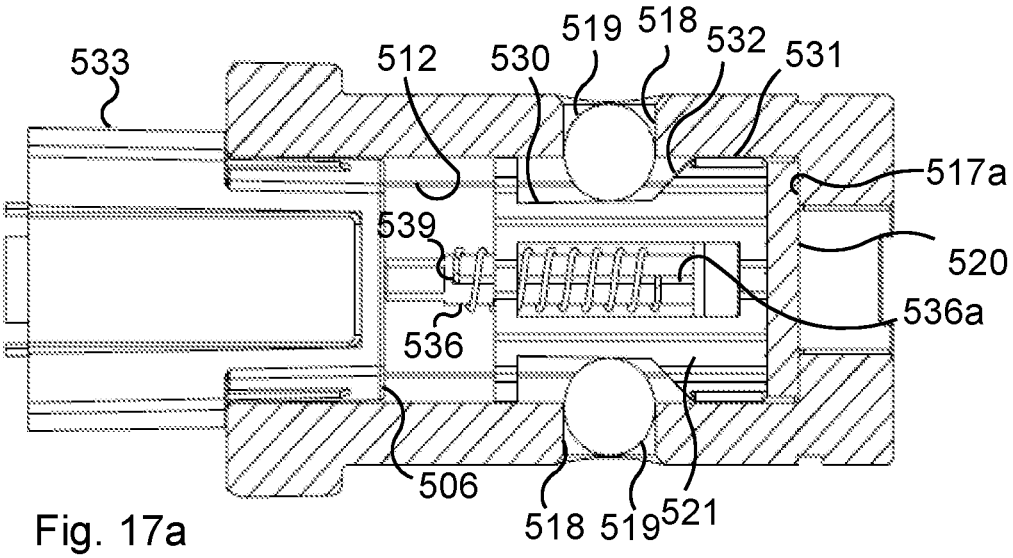
FIGS. 17*a* and 17*b* are longitudinal sections through the coupling device shown in FIG. 15, illustrating different operational positions of the components.
Figure 18:
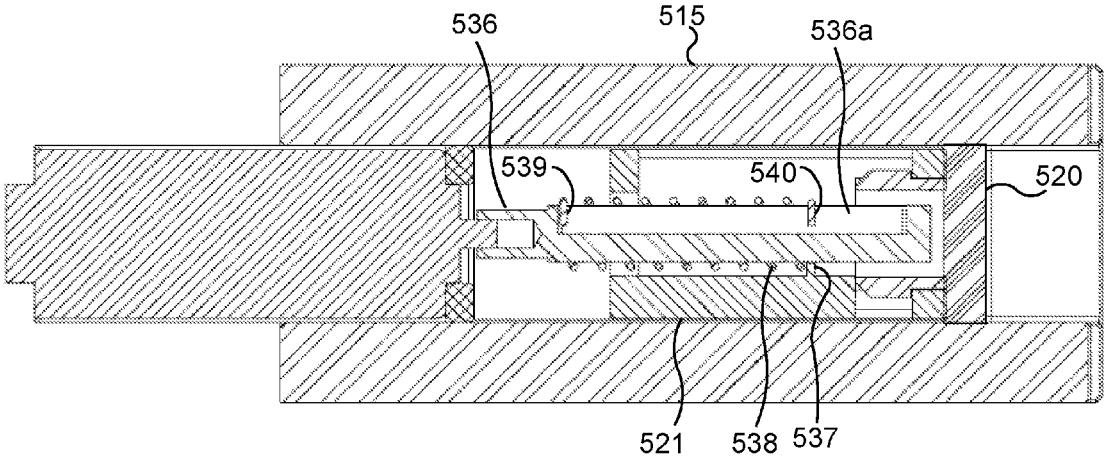
FIG. 18 is a longitudinal section along a plane which is perpendicular to the section shown in FIGS. 17*a* and 17*b*.

In FIGS. 17*a* and 18 the drive member 521 is positioned in a first end position. In this position the first axial portion 530 of the drive member 521, having the smallest radial thickness, is aligned with the engagement bores 518. The engagement members 519 are thereby allowed to be radially withdrawn, such that they do not protrude radially outside of the first coupling member 515. In this position output shaft 536 and the coil spring 538 has been rotated in a first rotational direction such that the spring engagement member 537 has been brought out of engagement between any two adjacent coils of the helical coil spring 538. Instead, spring engagement member 537 bears against the outer side of the rightmost (as in FIGS. 17*a* and 18) end coil of the spring 538. The spring, being axially supported by the leftmost end of the slit 536*a* is somewhat compressed such as to exert an pretension force to the spring engagement member 537 and thereby the drive member 521. The drive member 521 is thus pressed against the stop plate 520 in order to maintain the first portion 530 aligned with the engagement bores 518.

Figure 17B:
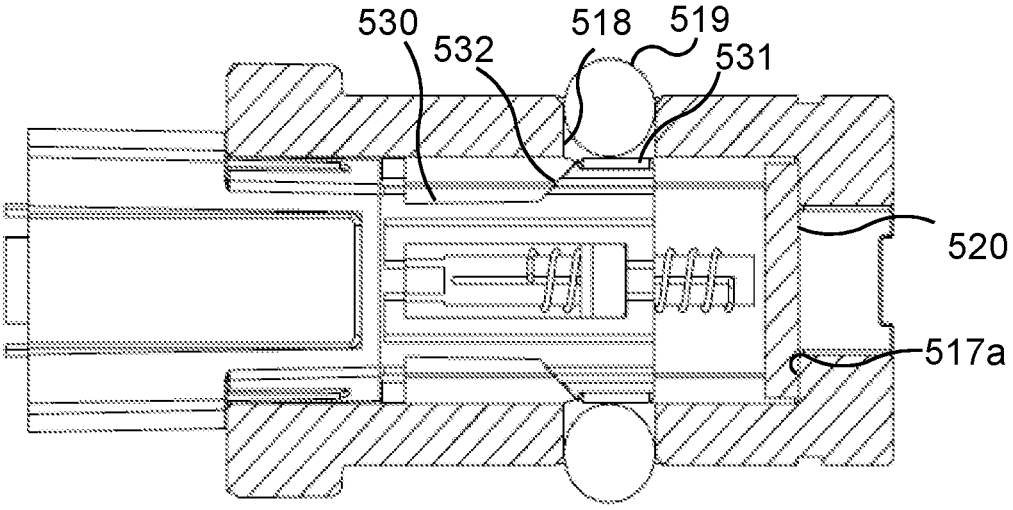

When the coupling device is to be switched to the simultaneous engagement position, i.e. to displace the drive member 521 to the left as seen in the figures, such that the engagement members 519 are displaced radially outwardly, the motor is powered to rotate in a first direction. The spring engagement member 537 thereby enters the open right end of the coil spring 538 and is engaged between consecutive adjacent coils of the coil spring 538. During continued rotation of the motor 506 the coil spring is displaced to the right as seen in the figures until the rightmost end leg 540 reaches and bears against the rightmost end of the slit 536*a*. Simultaneously or thereafter, the spring engagement member 537 and the drive member 521 are displaced axially to the left as seen in the drawings, until the drive member 521 bears against the stop surface formed by the front end of the motor 506. During continued rotation of the motor 506, the output shaft 506, and the coil spring 538, the spring engagement member 537 will compress the spring 538 and finally be brought out of engagement between the coils, such that it bears against the left end of the spring 538. This position is shown in FIG. 17*b*, even though the spring engagement member 537 is not visible in this figure. At this position the compression of the spring exerts a pretension force, directed to the left as seen in the figures, to the spring engagement member 537 which force is transmitted to the drive member. By this means the drive member 521 is pressed and maintained against the front end of the motor 506 and the second portion 531 is maintained in alignment with the engagement bores 518, such that the engagement members are securely maintained in the radially outwards projecting position for simultaneous engagement with the first coupling member 515 and a second coupling member. The second coupling member is not shown in FIGS. 15-17*b*, but it is readily understood that the second coupling member may be formed and function in correspondence with the second coupling member according to the first embodiment described above.

When the coupling device is again to be switched to the non engagement position shown in FIGS. 17*a* and 18 the motor is powered for rotation in the opposite direction. During rotation of the motor 506, the output shaft 536 and the coil spring 538, the drive member 521 with the spring engagement member 537 and the coil spring 538 will preform opposite axial displacements in reversed order such as to again resume the positions shown in FIGS. 17*a* and 18, where the drive member is pressed and maintained resting against the stop plate 520.

At the handle device according to the sixth embodiment, the radial dimensions of the coupling device may be reduced even further since the end legs of the helical coil spring project radially inwardly instead of outwardly, as is the case in embodiment one to five.

The sixth embodiment may be varied e.g. by extending the axial length of the slit 536*a* such that it extends over the entire length of the output shaft 536. In such case, the axial displacement of the coil spring relative to the output shaft may be limited by the front end of the motor and the stop plate, against which a respective end of the coil spring may take support.

The slit arranged in the output shaft may be widened in the circumferential direction, such as to allow some limited rotation of the coil spring in relation to the output shaft. Just as in the above described embodiments, such limited relative rotation decreases the starting torque of the motor.

At the above described embodiments, it is possible to increase the length of the coil. Such an increase results in that it is possible to achieve a greater compression by the same limited motor torque. It is also possible to reduce the pretensional force exerted by the coil spring while still assuring the drive member to be securely maintained in its respective axial end positions. By this means the wear of the coils spring, the output shaft with slit and the spring engagement member may be reduced. At the sixth embodiment, such an increase of the coil spring's length may be accomplished without increasing the total length of the coupling device.

Exemplifying embodiments of the inventive handle device have been described above. The invention is however not limited to these embodiments but may be varied freely within the scope of the appended claims. For example, instead of being provided with a key pad for entering an authorization code, the handle device may have any other suitable means for verifying the authorization of a user. Examples of such means include RFID-readers, mechanical or electro-mechanical key cylinders and RF receivers for remote control at a comparatively long distance. Additionally, the number and shape of the engagement members may be varied to a great extent. The handle device may e.g. be provide with a single or multiple engagement members formed as axially extending cylindrical rods that are displaceable either radially or axially. An axially displaceable engagement member may also be formed with radially or axially extending teeth that are able to engage corresponding recesses or cavities in the second coupling member. It is also understood that the different aspects and features of the exemplifying embodiments described above may be varied between the embodiments. For example, coupling devices comprising a rotational spring engagement member and a coli spring which is fixed to a drive member as well as coupling members comprising a coil spring which is fixed to the output shaft and a spring engagement member fixed to the drive member may by utilized at handle devices comprising both radially and axially displaceable engagement members. Correspondingly, both types of coupling devices may be utilized at handle devices comprising a first rotational element and a second stationary element, as well as at such handle devices where both the first and the second element are rotational.

It is further understood that various aspects of the different embodiments may be added. For example, according to a possible embodiment which has not been illustrated or described above, the handle device may comprise a first rotational element and two second elements, one of which is stationary and one of which is rotational. The coupling device may then comprise a first coupling member which is connected to the first element and two second coupling members that are connected to a respective one of the stationary and the rotational second elements. The coupling arrangement may then comprise one or several engagement members which, in a first operational position is in engagement with the first coupling member and the second coupling member being connected to the stationary element but out of engagement with the second coupling member being connected to the rotational second element. In such an operational position, the first element is thus locked relative to the stationary second element and the rotational second element is free swinging in relation to the first element and the stationary second element. When the engagement member has been displaced to a second operational position, it may be in engagement with the first coupling member and the second coupling member being connected to the rotational second element but out of engagement with the second coupling member being connected to the stationary second element. In this operational position, the first element may be rotated and its rotational movement is transmitted to the second rotational element for effecting an operational movement of a lock bolt or any other lock component or arrangement being connected to the second rotational element.

Further, at embodiments where the engagement members are axially displaceable and received in one or more axially extending slits in the second coupling member, the engagement between the engagement member and the slit may be used for preventing rotation of the drive member. In such embodiments, the drive member and the recess or cavity in the first coupling member, in which recess the drive member is received may have circular cross sections.

A flexible shaft portion as shown in FIGS. 13 and 14 may be arranged between the motor and the shaft portion extending through the interior recess of the drive member of handle devices of all types as illustrated in the other figures.

I claim:

1. Handle device for operating doors, windows and the like, comprising a first element (3), which is rotatable about an axis of rotation, a second element (8, 108, 208, 308), and a coupling device which is arranged to selectively allow and prevent relative rotation about the axis of rotation between the first and the second element, the coupling device comprising;

a first coupling member (15, 115, 215, 315, 515, 615) being connected to or forming an integral part of the first element a second coupling member (8, 150, 208, 350) being connected to or forming an integral part of the second element, at least one engaging member (19, 119, 219, 319, 519) which is displaceable between an engagement position in which it simultaneously engages the first and the second coupling members to thereby prevent relative rotation between the first and second element and a release position in which it is disengaged from at least one of the first and second coupling members to thereby allow relative rotation between the first and second element, a drive member (21, 121, 221, 321, 421, 521, 621) which is arranged axially displaceable, concentrically with said axis of rotation, by means of an electrical motor (6, 106, 206, 306, 406, 506) having a rotational output shaft (36, 136, 236, 336, 436, 536, 636); wherein the engaging member and drive member comprise interacting contact surfaces arranged, during axial displacement of the drive member, to displace the engagement member from the release position to the engagement position;

characterized in that the drive member exhibits an interior recess (27, 127, 227, 327, 427, 527);

a portion (36, 136, 236, 336, 436*a*, 536, 636) of the output shaft extends axially through the recess;

a helical coil spring (38, 138, 238, 338, 538, 638) is arranged in the recess, concentrically about the output shaft, limitedly axially displaceable relative to the drive member and the output shaft and prevented from free rotation relative to the drive member or the output shaft; and in that the output shaft or the drive member is provided with a radially extending spring engagement member (37, 137, 237, 337, 537, 637) which is arranged to engage the helical coil spring for axial displacement of the drive member relative to the output shaft upon rotation of the output shaft.

2. Handle device according to claim 1, wherein the coil spring (38, 138, 238, 338, 538, 638) has open ends.

3. Handle device according to claim 1, wherein the coil spring (38, 138, 238, 338, 538, 638) is open wounded.

4. Handle device according to claim 3, wherein the distance between adjacent coils of the coil spring (38, 138, 238, 338, 538, 638) is larger than the extension of the spring engagement member (37, 137, 237, 337, 437, 537, 637), in the direction parallel to the rotational axis.

5. Handle device according to claim 1, wherein the spring engagement member (37, 137, 237, 337, 437), is fixed to the output shaft (36, 136, 236, 336, 436) and projects radially outwardly.

6. Handle device according to claim 5, wherein the at least one end leg (39, 40) project outwardly and the drive member (21, 121, 221, 321, 421) comprises a first and a second leg support (42, 43), which are arranged to allow a limited rotation of the coil spring (38, 138, 238, 338, 438) relative to the drive member.

7. Handle device according to claim 6, wherein the leg supports (42, 43) are arranged to allow 30° to 350°, preferably approximately 180° rotation of the coil spring (38, 138, 238, 338, 438) relative to the drive member (21, 121, 221, 321, 421).

8. Handle device according to claim 6, wherein the leg supports (42, 43) are formed as a respective axially extending inner wall surface of the drive member (21, 121, 221, 321, 421).

9. Handle device according to claim 1, wherein the spring engagement member (537, 637) is fixed to the drive member (521, 621) and projects radially inwardly.

10. Handle device according to claim 9, wherein the at least one end leg (539, 540, 639, 640) projects inwardly and the output shaft (536, 636) is provided with an axially extending slit (536*a*, 636*a*) which receives the at least one end leg.

11. Handle device according to claim 10, wherein the slit has a circumferential extension such as to allow a limited rotation of the coil spring relative to the output shaft.

12. Handle device according to claim 1, wherein the coil spring (38, 138, 238, 338, 538, 638) comprises at least one radially or tangentially projecting end leg (39, 40, 539, 540, 639, 640).

13. Handle device according to claim 12, wherein the coil spring (38, 138, 238, 338, 538, 638) comprises two end legs (39, 40, 539, 540, 639, 640) which are essentially aligned in the axial direction of the coil spring.

14. Handle device according to claim 1, wherein the output shaft (436) comprises a flexible portion (436*b*) arranged outside of the recess (427).

15. Handle device according to claim 1, wherein the at least one engagement member (19, 119, 519) is radially displaceable in and out of simultaneous engagement with the first (15, 115, 515) and second (8, 150) coupling member.

16. Handle device according to claim 1, wherein the at least one engagement member (219, 319) is arranged axially displaceable in and out of simultaneous engagement with the first (215, 315) and second (208, 350) coupling members.

17. Handle device according to claim 1, wherein the second element (108, 308) is a rotational shaft connectable to a lock arrangement.

18. Handle device according to claim 1, wherein the second element (8, 208) is a stationary member which is fixable to a door, a window or the like.

* * * * *